US009015877B2

(12) United States Patent
Litwhiler

(10) Patent No.: US 9,015,877 B2
(45) Date of Patent: Apr. 28, 2015

(54) SPLASH GUARD TOWEL

(76) Inventor: Carla Elizabeth Litwhiler, Colorado Springs, CO (US)

( * ) Notice: Subject to any disclaimer, the term of this patent is extended or adjusted under 35 U.S.C. 154(b) by 607 days.

(21) Appl. No.: 13/399,491

(22) Filed: Feb. 17, 2012

(65) Prior Publication Data

US 2012/0167298 A1 Jul. 5, 2012

Related U.S. Application Data

(63) Continuation-in-part of application No. 11/906,598, filed on Oct. 3, 2007, now abandoned.

(51) Int. Cl.

| | |
|---|---|
| ***E03C 1/186*** | (2006.01) |
| ***A47K 1/06*** | (2006.01) |
| ***A47K 3/30*** | (2006.01) |
| ***E03C 1/181*** | (2006.01) |

(52) U.S. Cl.
CPC ..... *A47K 3/302* (2013.01); *E03C 1/181* (2013.01)

(58) Field of Classification Search
USPC ..... 4/657, 658, 300.3, 655
See application file for complete search history.

(56) References Cited

U.S. PATENT DOCUMENTS

| | | | | |
|---|---|---|---|---|
| 2,011,662 | A * | 8/1935 | Thompson | 4/558 |
| 2,878,487 | A * | 3/1959 | Foote | 4/610 |
| 6,044,891 | A * | 4/2000 | Guo | 160/370.21 |
| 6,178,571 | B1 * | 1/2001 | McAllister | 4/613 |
| 6,820,290 | B1 * | 11/2004 | Mullick et al. | 4/663 |
| 2001/0039677 | A1 * | 11/2001 | Bryce | 4/609 |
| 2004/0257656 | A1 * | 12/2004 | Sellgren et al. | 359/512 |
| 2006/0242758 | A1 * | 11/2006 | Hall | 4/601 |
| 2007/0215493 | A1 * | 9/2007 | Servis | 206/5 |
| 2010/0325791 | A1 * | 12/2010 | Davidowitz | 4/655 |

* cited by examiner

*Primary Examiner* — Justin Jonaitis
*Assistant Examiner* — Chee-Chong Lee
(74) *Attorney, Agent, or Firm* — J. Wiley Horton

(57) ABSTRACT

A splash guard designed to protect the gap between the back of a sink and the adjoining wall or mirror. The guard has an upper edge and a lower edge. There upper edge is attached to the mirror, preferably through the use of suction cups. The lower edge is provided with a bendable bar which a user can bend—using hand strength—into any desired shape. The bendable bar is bent into a shape which conforms the lower edge of the guard to the posterior sink geometry. The lower edge is then placed immediately behind the posterior sink geometry.

7 Claims, 5 Drawing Sheets

SPLASH GUARD TOWEL

CROSS-REFERENCES TO RELATED APPLICATIONS

This application is a continuation-in-part of U.S. application Ser. No. 11/906,598. The parent application was filed on Oct. 3, 2007. It listed the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of Invention

This invention relates to a towel specifically designed to prevent splashing of liquids behind a sink.

Millions of people dread performing common household tasks, such as laundry, dishes and cleaning the surrounding area of a sink, because of the time and energy they consume. In today's fast paced society, few individuals have a great deal of leisure time and even a smaller amount of time for chores. One area of the house that people dread cleaning is the sink and surrounding area. As the sink is used by all members of the household each day for brushing teeth, washing hands, shaving, or doing ones hair and makeup, it tends to get dirty rather quickly.

2. Prior Art

A few types of splash-guard apparatuses have been introduced. Two that provide a means for protecting a bathroom sink and surrounding area fall short of practicality. U.S. Pat. No. 4,722,103 to Kliebert (1988) shows a translucent plastic or glass splash guard that sits on countertop, behind sink & over the faucet fixtures. When certain hygienic acts are performed (brushing teeth, washing hands, shaving, etc.) and completed, the faucet and fixtures and areas to the left and right of the sink remain messy. One would have to additionally clean the translucent plastic or glass apparatus separately multiplying the household chores.

U.S. Pat. No. 6,212,708 to Mulaw (2001) discloses a faucet splash guard that consists of a free standing unit that contains a rear wall, two side walls and shelves. This structure although providing added storage space, is cumbersome and also would require cleaning after sink usage. This does not decrease the amount of household chores, however adds to it.

Other types of splash guard devises have been proposed—for example, U.S. Pat. No. 2,762,062 to Barton (1956), U.S. Pat. No. 2,635,253 to Kirvay (1953) and U.S. Pat. No. 6,564,398 to Trott (2003). Although functional in their own right, do very little to reduce the amount of splashing of liquid-like substances onto vanity, mirror and surrounding sink areas. Therefore, said inventions do little to decrease the frequency of cleanings in those areas. In addition, these devises offer few, if any, alternative uses.

BRIEF SUMMARY OF THE INVENTION

A new invention, the Splash-Guard Towel, was created for the purpose of keeping the mirror and all surrounding sink areas cleaner for a longer period of time. The Splash-Guard Towel is secured in place behind the sink by being attached to the mirror or the wall. The Splash-Guard Towel captures and absorbs water that splashes while people are washing their hands, washing their face, washing their hair, shaving, brushing their teeth, etc. With the Splash-Guard Towel, cleaning the mirror, countertop, sink fixtures, and surrounding area will be required less frequently.

The Splash-Guard towel is designed to be adaptable to a wide variety of sink geometries. The lower portion of the towel includes a bendable bar in a pocket. The user may bend this bar so that the lower portion of the towel closely conforms to the area just behind the sink/faucet. The towel thereby guards the area behind the sink.

REFERENCE NUMERALS IN THE DRAWINGS

| | |
|---|---|
| 1 pocket | 2 stitched seam |
| 3 sheet | 4 bendable bar |
| 5 suction cup | 6 eyelet/grommet |

DETAILED DESCRIPTION OF THE INVENTION

Figure 1:
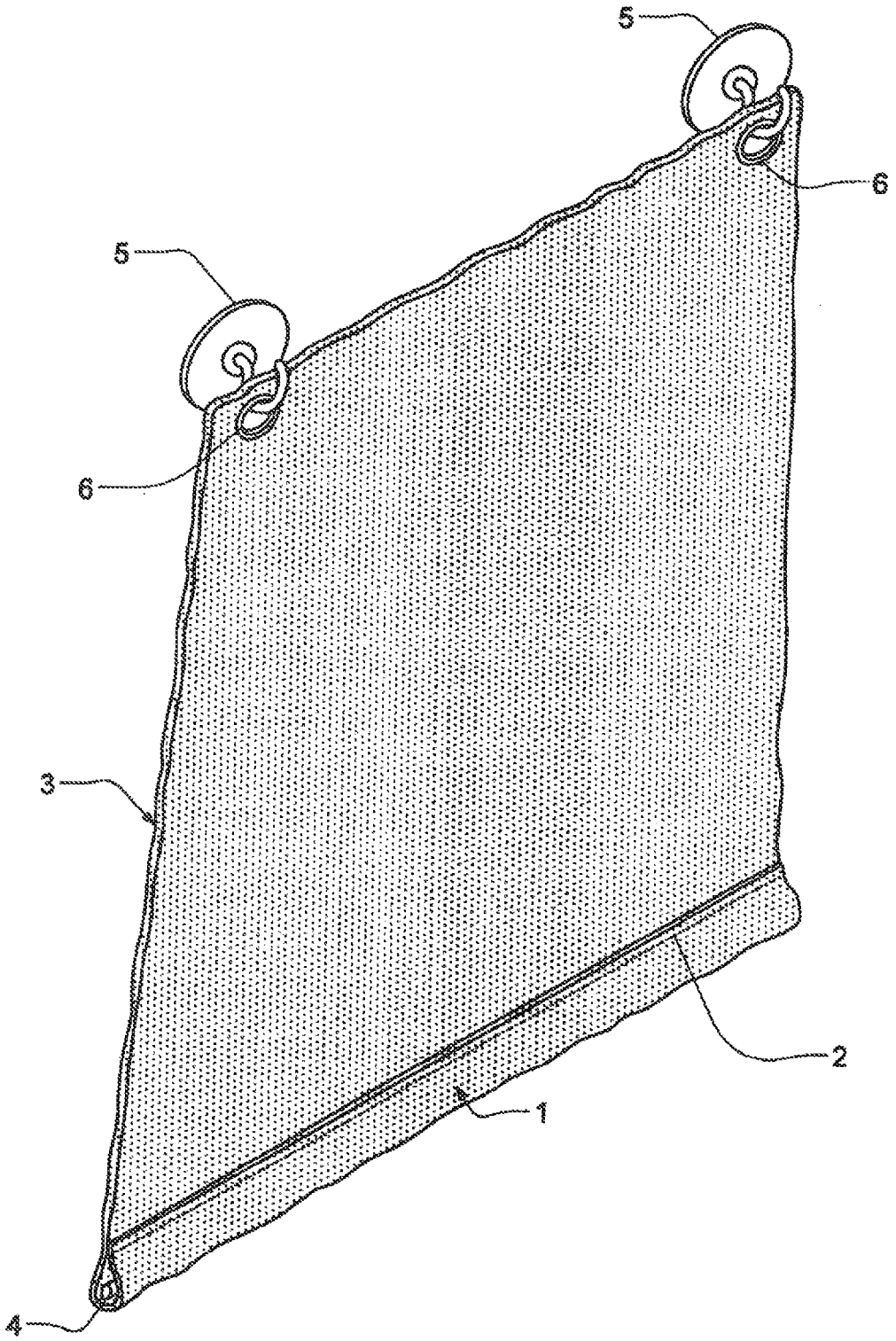
FIG. 1 is a perspective view, showing the splash-guard towel.

The embodiment of the Splash-Guard Towel design as illustrated in FIG. 1 preferably uses textiles, plastic and metal as its major components. The Splash-Guard Towel would be constructed of the best quality materials commonly accepted and used in the manufacturing industry today. I presently contemplate the main component of the Splash-Guard Towel in FIG. 1 would be a sheet 3, which is made of flexible, absorbent or repellant material such as a terry or cotton cloth fabric. This fabric will be trapezoidal in shape as shown in FIG. 1—meaning that it is wider at the bottom than at the top. I presently contemplate that the dimensions of the towel in FIG. 1 will be preferably be about 45 cm in height, about 80 cm in width along the bottom edge, and about 40 cm in width along the top edge. However, other materials and sizes of the Splash Guard Towel are also suitable.

Figure 2:
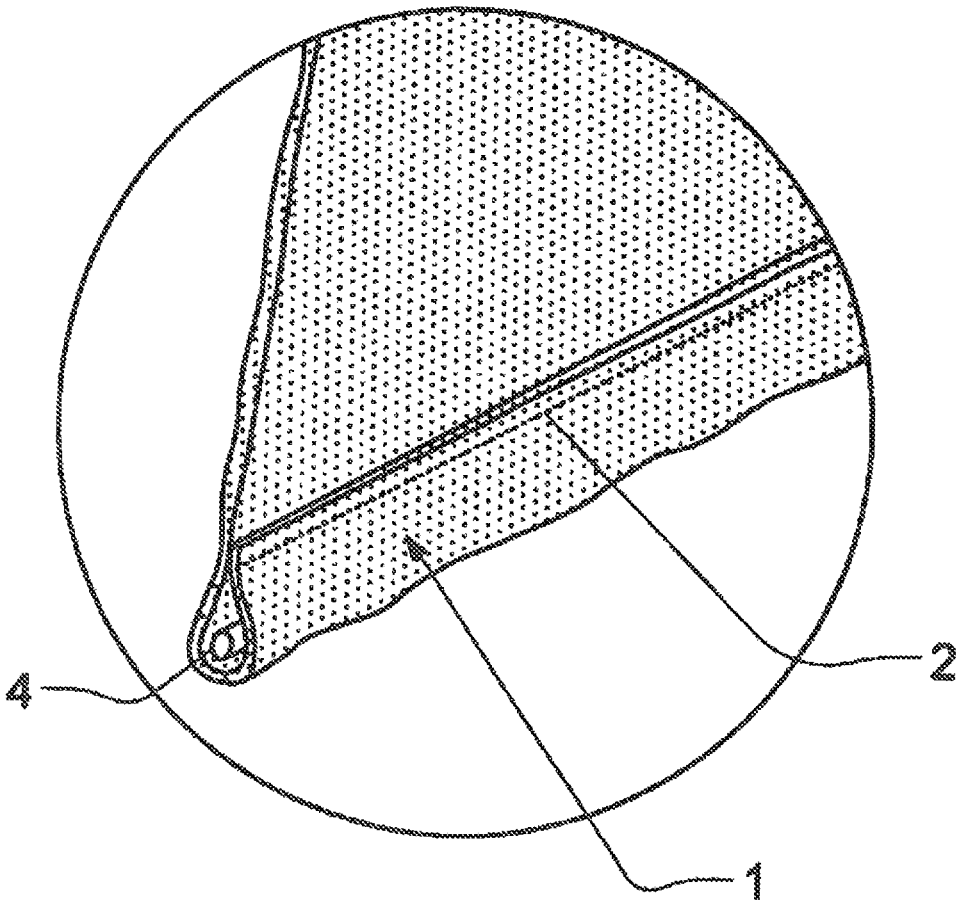
FIG. 2 is a detailed perspective view, showing one embodiment of the pocket and bendable bar.

The bottom of the towel includes a bendable bar which is connected to the towel by any suitable method. One approach is to create pocket 1 along the lower end by lapping the sheet over and creating stitched seam 2. FIG. 2 shows this area in greater detail. Bendable bar 4 is located along the bottom of the Splash-Guard Towel in pocket 1.

The bendable bar is made of any material which can be manually bent by the user and which will retain its deformed state when pressure is released. One example is a length of aluminum or steel wire. In a preferred embodiment, the bendable bar is a round aluminum wire having a diameter of about 2 mm. The use of the term "bar" should not be viewed as limiting this component to any particular shape. Other embodiments may use a rectangular cross section, a square cross section, an oval cross section etc.

Figure 3:
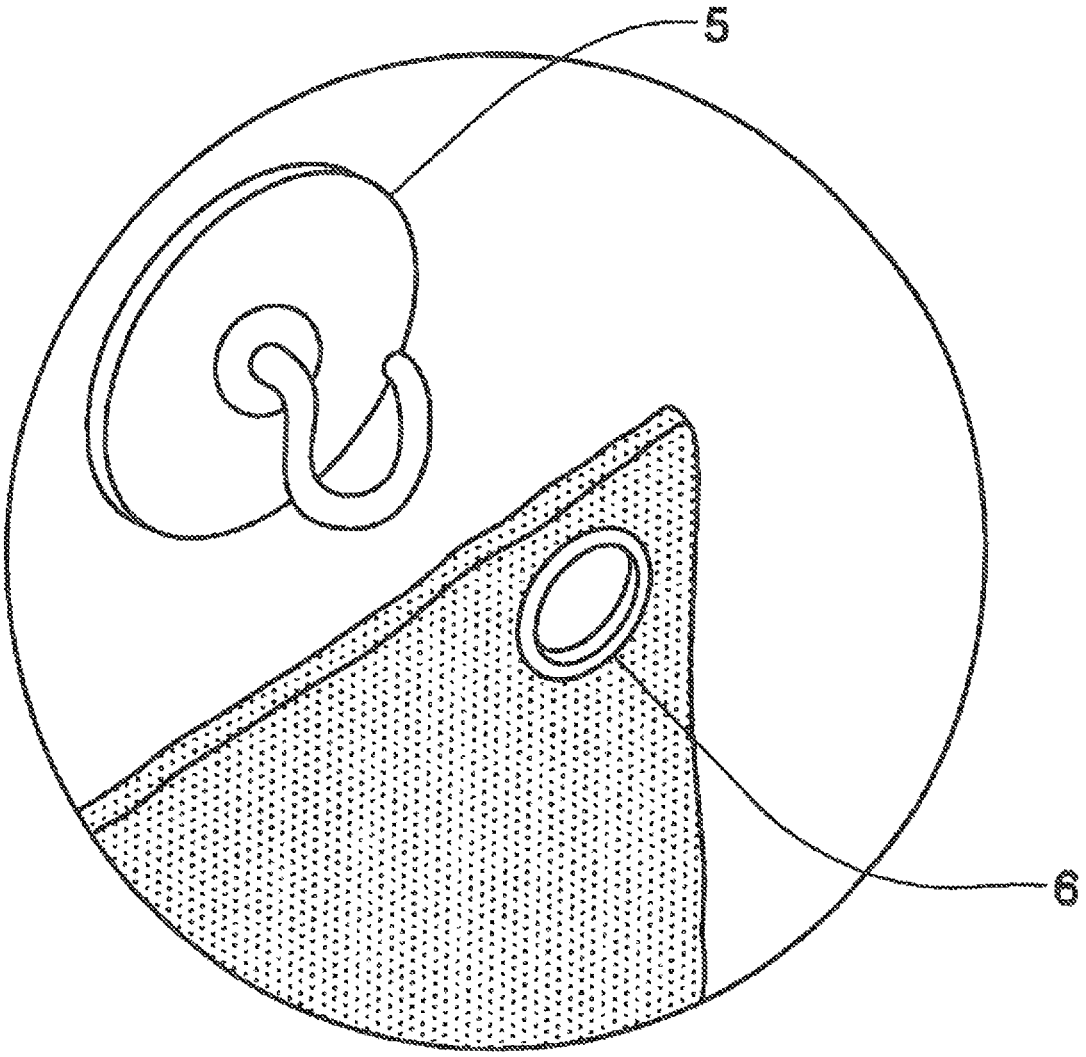
FIG. 3 is a detailed perspective view, showing one option for connecting the towel to the suction cups.

The typical eyelet/grommet 6 (FIG. 3) of the embodiment of FIG. 3 are positioned at each of the top corners of the Splash-Guard Towel. I presently contemplate the typical eyelet/grommet 6 (FIG. 3) will be 6.544 mm and comprised of plastic or metal. The Splash-Guard Towel is attached to a mirror by hanging the eyelet/grommet 6 (FIG. 3) on a typical 4.445 cm suction cup hook 5 (FIG. 3). However, other sizes and materials of the typical eyelet/grommet or typical suction cup hook are also suitable. The suction cup may also be more directly attached to the towel—such as by a heat staking process.

The production process related to the use of these metals would ensure that they were produced so as to be flexible, non-corrosive, durable and strong. The selected metals should have high impact strength and be able to accept and retain coloring materials for an extended length of time.

The Splash-Guard Towel illustrated in FIG. 1 is intended to protect the wall, the mirror, and the area directly behind the sink from splashes resulting from individuals washing their face, hands, hair, shaving and brushing their teeth. The Splash-Guard Towel will result in the mirror, countertop and surrounding area having to be cleaned less frequently.

Figure 4:
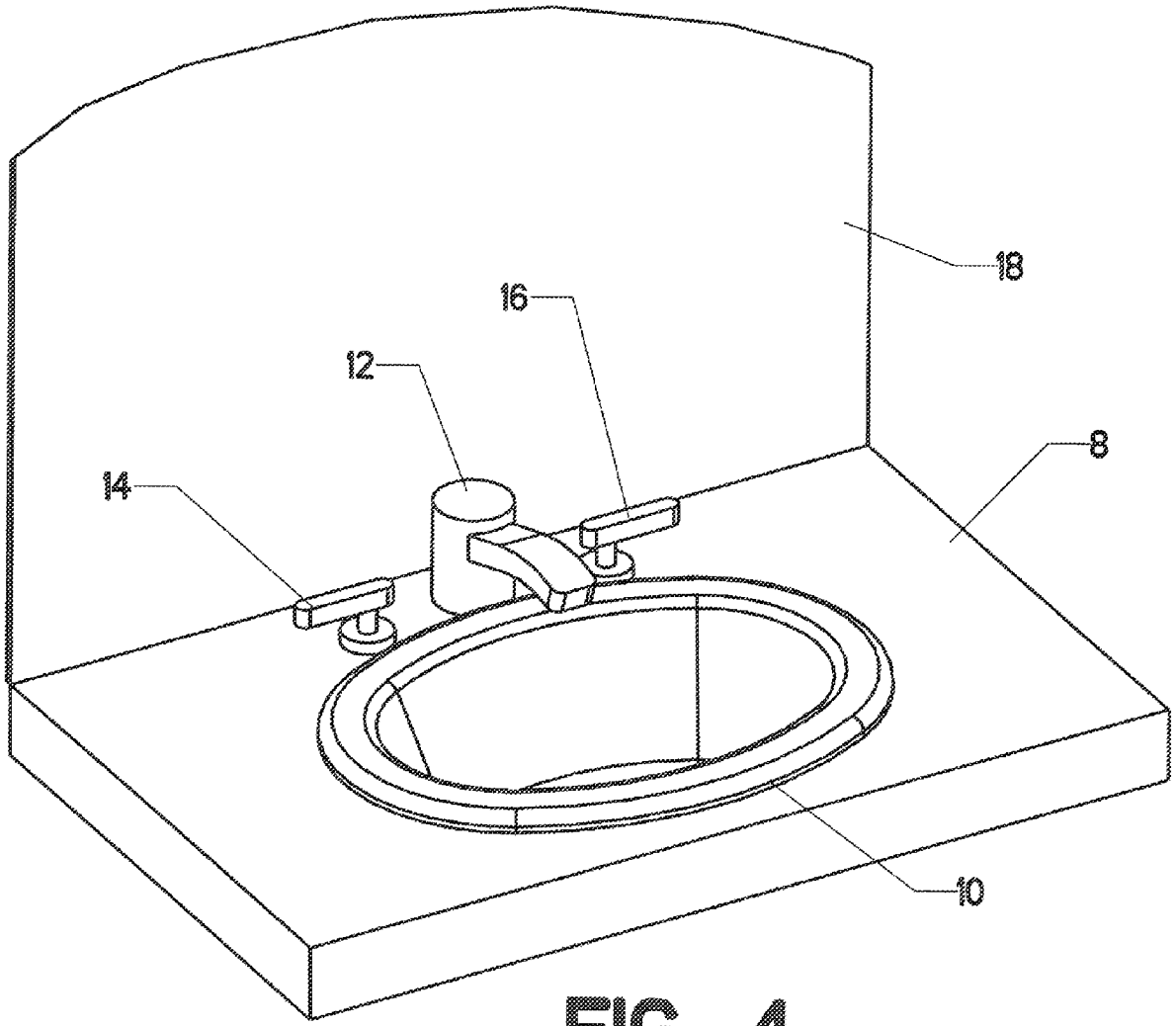
FIG. 4 (PRIOR ART)
FIG. 4 is a perspective view, showing a prior art vanity and mirror.
Figure 5:
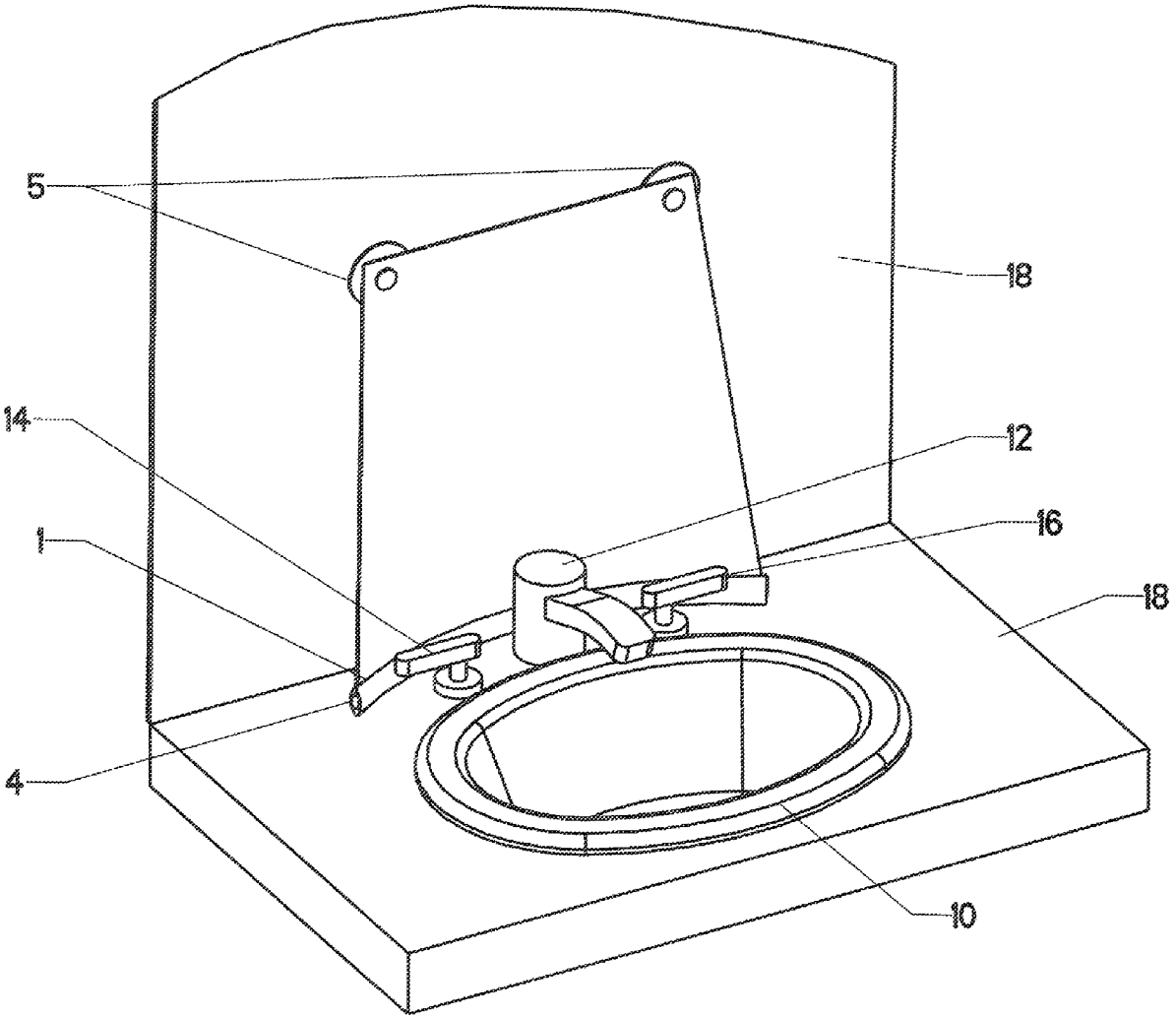
FIG. 5 is a perspective view, showing the present invention installed on the prior art vanity and mirror.

FIGS. 4 and 5 are presented to illustrate how the Splash-Guard towel is used. FIG. 4 shows a prior art vanity. Counter top 8 mounts sink 10. Mirror 18 is attached to the wall directly behind counter top 8. In the particular version shown, faucet 12 is flanked by hot valve 14 and cold valve 16. Those skilled in the art will realize that many different types of sinks and faucets are in common use. Some faucets have the valve mechanism integrated into the faucet itself.

The sink is depicted as an oval shape, but many other shapes are in common use. Some sinks are square, some are round, and still others are combinations of these shapes. Some sinks actually incorporate the mounting positions for the faucet and valves. In other sinks this is separate. The Splash-Guard towel is intended to guard the area immediately behind the faucet. It must therefore be able to conform to the wide range of different geometries encountered. Accounting for these variations is the function of the bendable bar incorporated in the towel's lower edge.

As stated previously, the posterior region of the faucet (including associated valves) and the sink is widely variable. A detailed discussion of these variations is not important, so long as the reader understands that the bendable bar allows the lower edge of the Splash-Guard to be conformed to virtually any geometry. For example, in some instances where the faucet mounting holes are within the perimeter of the sink itself, the "posterior sink geometry" will simply mean the smoothly curved geometry of the back edge of the sink. In other instances "posterior sink geometry" will include the edge of the sink, the faucet column, and the faucet valves. The bendable bar may be bent to pass smoothly around the rear perimeter of any of these variations in posterior sink geometry.

The area between the posterior sink geometry and the base of the mirror has no commonly used name. Accordingly, it will be referred to as the "posterior sink gap." The protection of the posterior sink gap is a significant objective of the present invention. This term should be understood to encompass the rare instance in which no mirror is attached to the wall behind the sink. The shape of the gap will be the same and the function of the Splash-Guard will be the same. In such a case the upper portion of the Splash-Guard would be attached to the wall instead of a mirror. The other functions would be the same. In the context of this invention, the term "mirror" should be understood to mean a vertical wall located behind a sink, irrespective of whether or not the vertical wall has a reflective coating.

The presence of the bendable bar allows the user to "customize" the shape of the towel's lower edge so that it lies closely behind the sink. FIG. 5 shows an installation of the Splash-Guard towel behind the sink of FIG. 4. The reader will note how bendable bar 4 has been bent to conform to the faucet-mirror gap as it exists for the particular sink configuration shown.

It is preferable for the bendable bar to be fairly heavy so that it will keep the lower edge of the towel in the position shown. The use of an aluminum or steel rod satisfies this need. Non-metallic alternatives could be used, provided that they are large enough and dense enough to provide the needed mass.

The upper edge of the Splash-Guard is attached to the mirror by pressing the suction cups 5 against the mirror. The sheet is preferably drawn fairly taut as shown in FIG. 5. The Splash-Guard thereby protects both the mirror and the faucet-mirror gap.

The Splash-Guard Towel as illustrated in FIG. 1 hangs from a mirror by placing each top corner plastic eyelet/grommet 6 (FIG. 3) onto the typical suction cup hook 5 (FIG. 3). The eyelet/grommet will be hung from typical suction cup 5 (FIG. 3) allowing the Splash-Guard Towel to be attached to a mirror.

The typical suction cup hook 5 (FIG. 3) will be positioned onto mirror approximately 40 cm above sink faucet. Each typical suction cup hook 5 (FIG. 3) will be approximately 36 cm apart from one another.

Once the typical suction cup hooks are 5 (FIG. 3) positioned at the desired height and width, one would place each corner typical eyelet/grommet 6 (FIG. 3) onto the appropriate typical suction cup hook 5 (FIG. 3). One could then reposition the typical suction cup hooks for the desired towel length coverage and draping.

Bendable bar 4 is preferably made removable. The suction cups and hanging hooks are also preferably made removable. This is done so that the towel may be washed using conventional equipment. Once the towel is washed, the suction cups and bendable bar are reinstalled and the unit is then placed back in its position guarding the mirror and the faucet-mirror gap.

CONCLUSION, RAMIFICATIONS, AND SCOPE

Accordingly, the reader will see that when the Splash-Guard Towel is secured in place behind the sink and is attached to the mirror or the wall, the Splash-Guard Towel will prevent splashing of liquids onto the mirror or nearby sink area. Furthermore, the Splash-Guard Towel has these additional advantages: it captures, absorbs or repels water that splashes while people are washing their hands, washing their face, washing their hair, shaving, brushing their teeth, etc.; hygienic and household it requires less frequent cleaning of the mirror, countertop, sink fixtures, and surrounding area; it can also be used as a hand towel when needed; it can also be used as an utility towel to clean surrounding area.

Although the description above contains much specificity, these should not be construed as limiting the scope of the embodiment but as merely providing illustrations of some of the presently preferred embodiments. For example, the Splash-Guard Towel can be manufactured in a variety of colors and materials so as to provide an assortment of aesthetically adaptable designs to consumers; the Splash-Guard Towel could also be made with several pockets that could be used for shaving supplies, toothbrushes, cosmetics, toiletries, etc.; the Splash-Guard Towel could be sold with both typical suction cups and typical wall hooks so that it may be installed wherever the consumer desires; the bendable bar that is to be placed inside the stitched seam or pocket could be coated in plastic or made of a plastic type material; self-adhesive industry-standard hook & loop fastener strips could be used as an alternative to the suction cups and hooks. The versatility of the Splash-Guard Towel makes it easily adaptable for usage in other locations such as kitchen and utility sinks.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the claims presented, rather than by the examples given.

Having described my invention, I claim:

1. A method for guarding the area behind a sink, comprising:

a. providing a vanity having a counter top, a sink, a faucet, and a mirror;

b. said sink and said faucet defining a posterior sink geometry;

c. said posterior sink geometry defining one boundary of a posterior sink gap between said posterior sink geometry and said mirror;

d. providing a sheet having an upper edge and a lower edge;

e. said sheet including a plurality of suction cups attached to said upper edge;

f. said sheet including a bendable bar attached to said lower edge, wherein said bendable bar may be plastically deformed by human hand strength into a desired shape which said bendable bar will thereafter retain;

g. pressing said plurality of suction cups against said mirror in order to attach said upper edge of said sheet to said mirror;

h. bending said bendable bar in order to conform said lower edge of said sheep to said posterior sink geometry; and i. placing said lower edge of said sheet in said posterior sink gap with said lower edge abutting said posterior sink geometry.

2. A method for guarding as recited in claim 1, wherein said sheet is given a trapezoidal shape with said upper edge being shorter than said lower edge.

3. A method for guarding as recited in claim 1, wherein said bendable bar is made of metal.

4. A method for guarding as recited in claim 3, wherein said bendable bar is aluminum.

5. A method for guarding as recited in claim 4, wherein said bendable bar is steel.

6. A method for guarding as recited in claim 1, wherein said bendable bar is removable from said sheet.

7. A method for guarding as recited in claim 1, wherein said suction cups are removable from said sheet.

* * * * *